United States Patent [19]

Robbins et al.

[11] 4,427,730

[45] Jan. 24, 1984

[54] TUBE PACKING SHEET WITH SPACED SUPPORT SURFACES

[75] Inventors: Gerald L. Robbins, East Vassalboro; Henry R. Vigue, Waterville, both of Me.

[73] Assignee: Keyes Fibre Company, Waterville, Me.

[21] Appl. No.: 371,600

[22] Filed: Apr. 26, 1982

[51] Int. Cl.[3] ..... B32B 3/02; B32B 3/26

[52] U.S. Cl. ..... 428/156; 206/419; 428/174; 428/179

[58] Field of Search ..... 428/174, 179, 182, 188, 428/156; 206/419; 217/26.5; D9/456

[56] References Cited

U.S. PATENT DOCUMENTS

| | | | |
|---|---|---|---|
| D. 143,042 | 11/1945 | Shepard | D58/16 |
| D. 217,541 | 5/1970 | Vigue | D9/99 |
| 2,564,729 | 8/1951 | Shepard | 206/419 |
| 2,568,769 | 9/1951 | Shepard | 206/419 |
| 2,984,345 | 5/1961 | Emery | 206/419 |
| 3,135,445 | 6/1964 | Reifers | 224/45 |
| 3,223,234 | 12/1965 | Weiss | 206/419 |
| 3,608,706 | 9/1971 | Vigue | 206/46 FR |

*Primary Examiner*—Paul J. Thibodeau

*Attorney, Agent, or Firm*—Connolly and Hutz

[57] ABSTRACT

YA molded sheet of the single layer type for packing at least two directly superimposed layers of fluorescent light tubes comprising upwardly directed contours including longitudinally spaced apart tube cradling surfaces for each tube and longitudinally extending narrow tube separating ribs for a plurality of tubes in an upper layer, and downwardly directed contours including a series of flat support surfaces to hold the rest of the sheet elevated thereabove to facilitate drying of the damp sheet during manufacture, the series of support surfaces being dimensioned and arranged to contact the upper part of the same number of tubes in a lower layer and resist lateral shifting of the upper layer of tubes with respect to the lower layer of tubes.

5 Claims, 6 Drawing Figures

TUBE PACKING SHEET WITH SPACED SUPPORT SURFACES

BACKGROUND OF THE INVENTION

This invention relates to the field of three-dimensionally contoured packing sheets molded to substantially finished form from resilient material such as fibrous pulp or foam plastic, for packing in a shipping case or other container a stack of at least two directly superimposed layers of a plurality of elongated fragile objects, such as cylindrical fluorescent light tubes.

Molded packing sheets have been used with great success for many years to pack elongated fluorescent light tubes in shipping cases. The purpose of the packing sheets is to safeguard the tubes against breakage, by protecting them from mutual contact in the shipping case, and also to facilitate loading a stack of two or more layers of the tubes into the shipping case. The sheets are made of resilient material, such as molded fibrous pulp, which imparts cushioning characteristics to further protect the fragile tubes against breakage when a shipping case of the same encounters rough handling.

A typical molded pulp packing sheet, of the single layer type over which the present invention is a new and useful improvement, is disclosed in Chadbourne U.S. Pat. No. Des. 249,638 issued September 1978. This consists of a packing sheet molded to substantially finished form from fibrous pulp material which is three dimensionally contoured to provide upwardly directed contours including longitudinally spaced apart tube cradling surfaces for each tube and longitudinally extending narrow tube separating ribs for a plurality of tubes in an upper layer, and downwardly directed contours including a series of flat support surfaces to hold the rest of the sheet elevated thereabove to facilitate drying of the damp sheet during manufacture. See also in this regard Emery U.S. Pat. No. 2,984,345 issued May 1961.

One problem with light tube packing sheets of this general type occurs during the process of loading a stack of several layers of packed light tubes into a shipping case, the problem being that one layer of packed tubes tends to shift laterally with respect to a vertically adjacent layer of packed tubes in the stack, and the resulting mis-alignment makes it difficult to load the stack into the shipping case.

This problem is an old one, which has been recognized since the 1940's, as explained in Shepard U.S. Pat. No. 2,564,729 issued August 1951, and also in Shepard U.S. Pat. Nos. Des. 143,042 issued November 1945 and 2,568,769 issued September 1951. The Shepard '729 patent utilizes a packing sheet of the "double layer" type which folds back upon itself to provide both upper and lower protection for the ends of the light tubes, and solves the lateral shifting problem by means of cooperating raised formations and recessed formations in a "vertical" stack in which the tubes are positioned vertically directly one above the other. The other two Shepard patents utilize a packing sheet of the "single layer" type which does not fold back upon itself, and solve the lateral shifting problem by means of centrally located downribs which fit between adjacent tubes in the next lower layer but in a "staggered" stack in which tubes are horizontally offset in alternate rows.

While the Shepard patents disclose downwardly contoured means to prevent lateral shifting of one packed layer of tubes with respect to the packed layer of tubes immediately therebelow in the stack, they do not disclose a means of preventing lateral shifting in a "single layer" packing sheet of the general type disclosed in the aforesaid Chadbourne patent, for use in a so-called "vertical" stack of light tubes.

Thus, the problem heretofore unresolved by the prior art is the use of a single layer type packing sheet which includes means to prevent lateral shifting of one packed layer of light tubes with respect to an adjacent packed layer of tubes in a vertical as opposed to a staggered stack of tubes.

SUMMARY OF THE INVENTION

The present invention provides a molded packing sheet of the single layer type for elongated fluorescent light tubes comprising upwardly directed contours including longitudinally spaced apart tube cradling surfaces for each tube and longitudinally extending narrow tube separating ribs for a plurality of tubes in an upper layer, and downwardly directed contours including a series of flat support surfaces to hold the rest of the sheet elevated thereabove to facilitate drying of the damp sheet during manufacture, the improvement being characterized in that the series of flat support surfaces is arranged to maintain a lower layer of the same number of tubes directly below the upper layer and in the same relationship in a lower flat plane parallel with the upper flat plane, each support surface being laterally elongated with a width to depth ratio which insures that the support surfaces will contact the upper part of the tubes in the lower layer and resist lateral shifting of the sheet and the upper layer of tubes packed therein with respect to the lower layer of tubes.

BRIEF DESCRIPTION OF THE DRAWINGS

Numerous advantages of the present invention will become apparent to one skilled in the art from a reading of the detailed description in conjunction with the accompanying drawings wherein similar reference characters refer to similar parts, and in which.

DETAILED DESCRIPTION OF THE INVENTION

Figure 1:
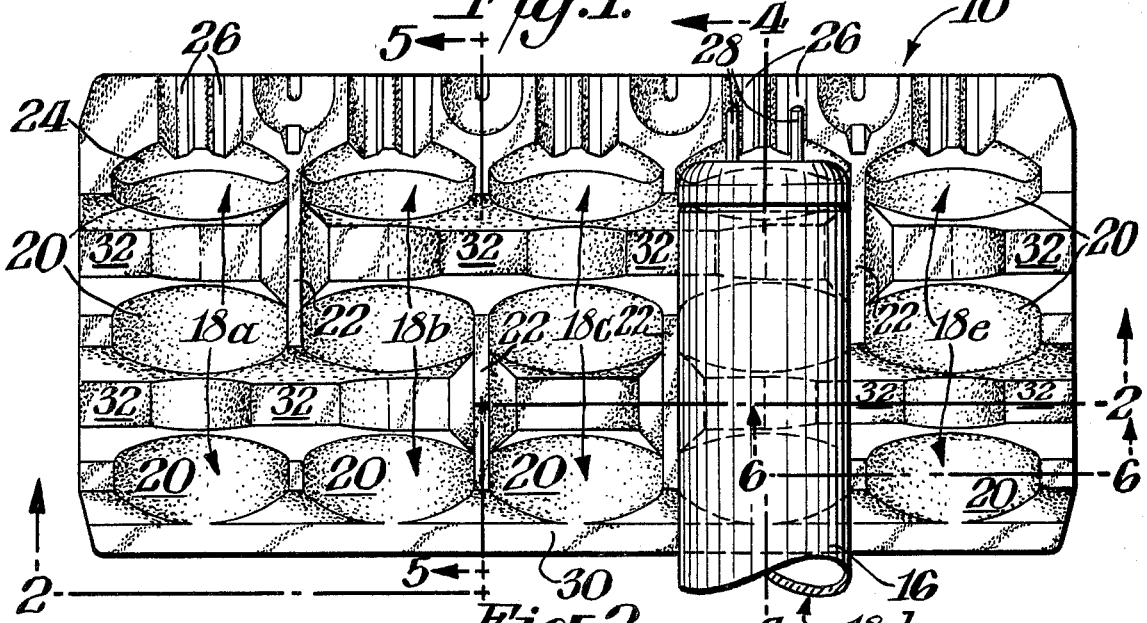
FIG. 1 is a plan view of a single layer molded packing sheet according to this invention, showing the spaced apart arrangement of the series of support surfaces, and with an end of one light tube positioned therein for purposes of illustration.

The molded packing sheet 10 according to this invention consists of a single layer of resilient material, such as molded pulp or foam plastic, which is three-dimensionally contoured for use in packing a stack of at least two superimposed layers 12, 14 of a plurality of elongated light tubes 16 for storage and shipment. In the disclosed embodiment, the sheet 10 is contoured for packing five tubes in each superimposed layer, and accordingly includes five tube troughs, designated from the left as 18*a*, 18*b*, 18*c*, 18*d* and 18*e*. The troughs 18 are formed by upwardly directed contours which position five tubes in closely spaced apart parallel relationship in a common flat plane.

The upwardly directed contours include at least two laterally concave tube cradling surfaces 20 for each tube in the upper layer. In the disclosed preferred embodiment, there are three such laterally concave cradling surfaces 20 for each of the tube troughs 18, and the cradling surfaces 20 are spaced apart longitudinally of a tube as it is received in a given trough. The tube cradling surfaces are laterally concave for approximately 180°, and cooperate to provide a longitudinally aligned bed for safely receiving the light tubes 16.

The upwardly directed contours further include longitudinally extending narrow ribs 22 upstanding between adjacent tubes in the upper layer to prevent lateral contact between such adjacent tubes. The longitudinal ribs 22 are of inverted V-shape transverse cross-section, and they extend upwardly to at least the mid-point to prevent lateral contact between the tubes. In the disclosed embodiment, the downwardly sloping side walls of the ribs 22 merge, in part, smoothly with the upward extremities of the concave tube cradling surfaces 20.

The upwardly directed contours further may include end wall configurations, as at 24, to prevent longitudinally outward sliding of the tubes in the troughs 18. Such end wall configurations further may include a pair of corrugations 26 to accommodate the end contact pins 28 of the tubes 16. Such end wall configurations are of a known construction, and may be utilized on the packing sheets designed for packing the ends of the light tubes, but are omitted from those packing sheets designed for cradling only the mid-portions of the tubes, as can be understood.

The upwardly directed cradling surfaces 20 are arranged in laterally extending rows, of which there are three in the disclosed embodiment. The outermost such row is adjacent and is formed as a part of the end wall configurations 24, and the innermost such row is adjacent the horizontal, flat inner edge 30 of the sheet 10. The laterally extending rows in which the cradling surfaces 20 are arranged are transversely interrupted by the longitudinally extending ribs 22.

Figure 2:
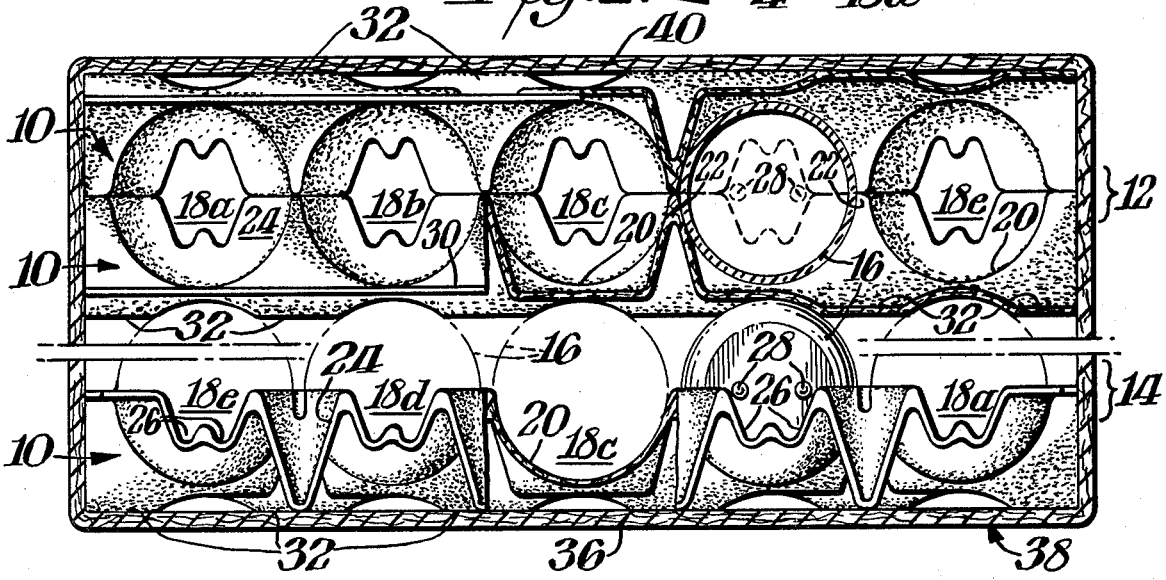
FIG. 2 is an end elevational view, partly in section on line 2—2 of FIG. 1, showing two superimposed layers of tubes in the packing sheets within a container.
Figure 3:
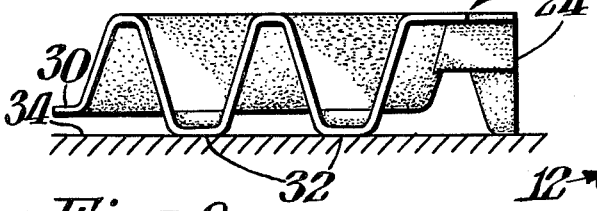
FIG. 3 is a side elevational view from the right-hand side of FIG. 1, with the light tube eliminated.

The packing sheet 10 further comprises downwardly directed contours, including a series of flat support surfaces 32. The bottoms of the flat support surfaces 32 are in a common flat plane, to hold the rest of the sheet 10 elevated thereabove. As seen in FIG. 3 the support surfaces 32 may rest on the surface of a drying conveyor 34, to hold the rest of the damp sheet elevated thereabove, to facilitate drying the sheet in a dryer oven during manufacture. Similarly, as seen in FIG. 2, the bottoms of the support surfaces 32 serve to hold the rest of the sheet 10 away from the bottom 36 of a shipping container 38. When such shipping container has a stack of at least two superimposed layers of light tubes packed therein, such as the layers 12, 14, then one of the packing sheets 10 may be inverted and placed atop the uppermost layer in the container 38, in which case the support surfaces 32 serve to hold the rest of the sheet away from the top 40 of the shipping container 38.

According to the preferred embodiment of this invention, the series of flat support surfaces 32 is further arranged to maintain a lower layer of the same number of tubes directly below the upper layer of tubes in the troughs of the sheet, and maintain the lower layer of the same number of tubes in the closely spaced apart parallel relationship in a lower flat plane parallel with the upper flat plane. Namely, the series of support surfaces 32 maintains the lower layer 14 of five tubes directly below the upper layer 12 of five tubes, rather than having the tubes laterally offset in adjacent layers in a so-called "staggered" stack.

The series of support surfaces 32 are arranged in at least two laterally extending rows, which are spaced apart longitudinally of the direction of the tubes in the troughs. Each such row includes at least two outermost support surfaces, one at each end of the row, which provides two support surfaces on each side of the sheet 10. This provides a widespread footing for the edges of the damp sheet on the dryer conveyor. The series of support surfaces 32 arranged in the two lateral rows further includes at least one support surface 32 between adjacent tubes in the lower layer. In the illustrated embodiment, for instance, the outermost row of support surfaces includes, in addition to the two end support surfaces, a support surface 32 between the second 18*b* and the third 18*c* troughs, and a support surface 32 between the third 18*c* and the fourth 18*d* troughs. The innermost row of support surfaces includes, in addition to the two end support surfaces, a support surface 32 between the first 18*a* and the second 18*b* troughs, and a support surface 32 between the fourth 18*d* and the fifth 18*e* troughs. With specific reference to FIG. 1, it can further be seen that the two laterally extending rows in which the support surfaces 32 are arranged alternate between the three laterally extending rows in which the cradling surfaces 20 are arranged. Furthermore, the flat support surfaces 32 are laterally elongated, with a width approximating the radius of a tube, the support surfaces being approximately twice as wide as they are long, and they are illustrated as being generally rectangular in plane view.

Figure 4:
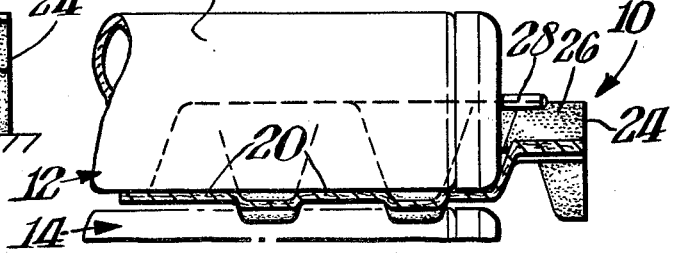
FIG. 4 is a sectional elevational view along the center of a tube trough on line 4—4 of FIG. 1.
Figure 6:
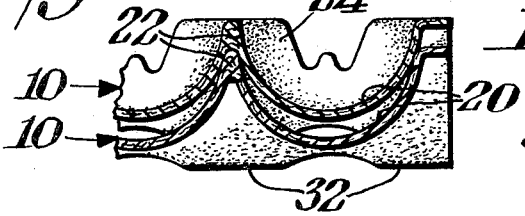
Figure 5:
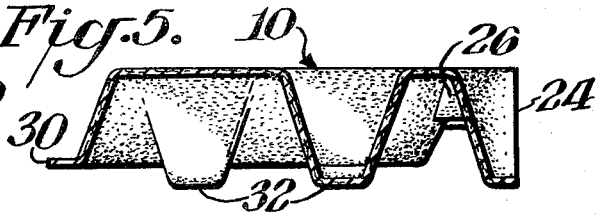
FIG. 5 is a sectional elevational view along a separating rib between tube troughs on line 5—5 of FIG. 1; and, FIG. 6 is a fragmentary sectional elevational view, on line 6—6 of FIG. 1, showing two empty packing sheets in a nested stack.

The width to depth ratio of the downwardly contoured support surfaces 32 is so dimensioned and arranged to insure that the lower portions of the support surfaces, and particularly the lateral side edges thereof, will contact the upper part of the tubes 18 in the lower layer, as best seen in FIG. 2 (longitudinally) and FIG. 4 (laterally). This contact resists lateral sliding or shifting of the sheet 10 (and the upper layer 12 of tubes 16 packed therein) with respect to the lower layer 14 of tubes 16.

As should be apparent from a careful inspection, FIG. 2 illustrates a shipping container 38 containing a stack of at least two superimposed layers 14, 12 of five elongated light tubes in each layer, as properly packed in the packing sheets 10. The packing sheet 10 supporting the lower layer 14 of tubes, which rests on the bottom 36 of the container 38, is viewed from the outermost end, wherein the end wall configurations 24, 26 are visible, and the mid-trough 18*c* is broken away for purposes of illustration. The packing sheet 10 for the upper layer 12 of tubes is at the longitudinally distant end of the container 38, so that the innermost flange 30 is visible at the left-hand side and the right-hand side is illustrated in transverse sectional elevation along the line 2—2 of FIG. 1. Finally, as mentioned above, an additional packing sheet 10 is inverted atop the upper layer 12 of tubes, to cushion the same against the inside of the top 40 of the container 38, after the known fashion.

While the above described embodiment constitutes the presently preferred mode of practicing this invention, other embodiments and equivalents are within the scope of the actual invention, which is claimed as:

1. A molded packing sheet of the type which is three dimensionally contoured for use in packing a stack of at least two superimposed layers of a plurality of elongated light tubes for storage and shipment, the sheet comprising (a) upwardly directed contours to position an upper layer of a plurality of tubes in closely spaced apart parallel relationship in a common flat plane, the upwardly directed contours including (i) at least two laterally concave tube cradling surfaces for each tube in the upper layer, the cradling surfaces being spaced apart longitudinally of the tube, and (ii) longitudinally extending narrow ribs upstanding between adjacent tubes packaged in the upper layer to prevent lateral contact between such adjacent tubes, and (b) downwardly directed contours to hold the rest of the sheet elevated thereabove, such contours including a series of flat support surfaces in a common flat plane, the improvement being that the series of flat support surfaces is arranged to maintain a lower layer of the same number of tubes directly below the upper layer and in the same relationship in a lower flat plane parallel with the upper flat plane, the series of support surfaces being in at least two laterally extending rows which are spaced apart longitudinally and including four outermost support surfaces one at each end of each row to provide two on each side of the sheet, and at least one support surface between adjacent tubes packaged in the lower layer, each support surface being laterally elongated with a width approximating the radius of a tube and a width to depth ratio which insures that the support surfaces will contact the upper part of the tubes in the lower layer and resist lateral shifting of the sheet and the upper layer of tubes packed therein with respect to the lower layer of tubes.

2. A molded sheet for packing tubes as in claim 1 wherein the support surfaces are approximately twice as wide as they are long.

3. A molded sheet for packing tubes as in claim 1 wherein the upwardly directed cradling surfaces are arranged in laterally extending rows which alternate with the rows in which the support surfaces are arranged.

4. A molded sheet for packing tubes as in claim 3 wherein the sheet is contoured for packing five tubes in each superimposed layer, each of the two rows in which the support surfaces are arranged has four support surfaces, one such row being characterized by the two end support surfaces plus a support surface between the second and third tubes and a support surface between the third and fourth tubes, and the other such row being characterized by the two end support surfaces plus a support surface between the first and second tubes and a support surface between the fourth and fifth tubes.

5. A molded sheet for packing tubes as in claim 4 wherein the support surfaces are generally rectangular with a width approximately twice their length.

* * * * *